US012130036B2

(12) United States Patent
Wang et al.

(10) Patent No.: US 12,130,036 B2
(45) Date of Patent: Oct. 29, 2024

(54) AIR CONDITIONER OUTDOOR UNIT, AIR CONDITIONER AND CONTROL METHOD THEREOF

(71) Applicant: Hisense (Guangdong) Air Conditioning Co., Ltd., Guangdong (CN)

(72) Inventors: Bin Wang, Guangdong (CN); Minan Wu, Guangdong (CN)

(73) Assignee: HISENSE (GUANGDONG) AIR CONDITIONING CO., LTD., Jiangmen (CN)

( * ) Notice: Subject to any disclaimer, the term of this patent is extended or adjusted under 35 U.S.C. 154(b) by 372 days.

(21) Appl. No.: 17/708,436

(22) Filed: Mar. 30, 2022

(65) Prior Publication Data

US 2023/0151992 A1 May 18, 2023

(30) Foreign Application Priority Data

Nov. 15, 2021 (CN) ..... 202111347192.X

(51) Int. Cl.
*F24F 11/63* (2018.01)
*F24F 1/20* (2011.01)
*F24F 11/88* (2018.01)

(52) U.S. Cl.
CPC ..... *F24F 11/63* (2018.01); *F24F 1/20* (2013.01); *F24F 11/88* (2018.01)

(58) Field of Classification Search
CPC .... F24F 1/20; F24F 11/61; F24F 11/63; F24F 11/65; F24F 11/88
See application file for complete search history.

(56) References Cited

U.S. PATENT DOCUMENTS

| | | | | |
|---|---|---|---|---|
| 10,139,793 | B2 * | 11/2018 | Yamada | G05D 23/1904 |
| 2018/0123508 | A1 * | 5/2018 | Inoue | H02M 3/158 |
| 2019/0123567 | A1 * | 4/2019 | Kaneko | B60L 50/60 |
| 2023/0035370 | A1 * | 2/2023 | Kishira | H02P 1/18 |

FOREIGN PATENT DOCUMENTS

| | | | |
|---|---|---|---|
| CN | 101770248 | A | 7/2010 |
| CN | 203747642 | U | 7/2014 |
| CN | 204787048 | U | 11/2015 |
| CN | 111928427 | A | 11/2020 |

(Continued)

OTHER PUBLICATIONS

Machine translation of CN 112865507, published 2012.*

(Continued)

*Primary Examiner* — Henry T Crenshaw
(74) *Attorney, Agent, or Firm* — Morgan, Lewis & Bockius LLP

(57) ABSTRACT

An air conditioner outdoor unit includes a power supply circuit, a load circuit and a main controller. The power supply circuit includes a resistor and a relay connected in parallel. The load circuit includes a plurality of sub-load circuits coupled to an output of the power supply circuit. The main controller is coupled to the relay, and in a case where the air conditioner outdoor unit is in a standby state, the main controller is configured to control the relay to turn off; and in a case where the air conditioner outdoor unit is in a working state, the main controller is configured to control the relay to turn on.

18 Claims, 5 Drawing Sheets

(56) References Cited

FOREIGN PATENT DOCUMENTS

| | | | | |
|---|---|---|---|---|
| CN | 112865507 | | * | 5/2021 |
| CN | 112865507 | A | | 5/2021 |
| CN | 112984749 | A | | 6/2021 |
| CN | 113587377 | A | | 11/2021 |
| JP | 2008141895 | A | | 6/2008 |

OTHER PUBLICATIONS

Chinese Notification to Grant Patent Right for Invention dated Apr. 9, 2023, issued in corresponding Chinese Patent Application No. 202111347192.X.
Chinese Office Action dated Apr. 9, 2023, issued in corresponding Chinese Patent Application No. 202111347192.X.
Office Action issued in corresponding Chinese Patent Application No. 202111347192.X dated Sep. 26, 2022 with English Translation.

* cited by examiner

AIR CONDITIONER OUTDOOR UNIT, AIR CONDITIONER AND CONTROL METHOD THEREOF

CROSS-REFERENCE TO RELATED APPLICATION

This application claims priority to Chinese Patent Application No. 202111347192.X, filed on Nov. 15, 2021, which is incorporated herein by reference in its entirety.

TECHNICAL FIELD

The present disclosure relates to the technical field of air conditioning, and in particular, to an air conditioner outdoor unit, an air conditioner and a control method thereof.

BACKGROUND

With an advancement of science and technology and an improvement of people's living standards, air conditioners have gradually entered people's lives and become an indispensable product in people's work and life.

An air conditioner (e.g., an inverter air conditioner) has a standby state and a working state, and a power consumption of the air conditioner in the standby state is an energy efficiency parameter of the air conditioner.

SUMMARY

In an aspect, an air conditioner outdoor unit is provided. The air conditioner outdoor unit includes a power supply circuit, a load circuit and a main controller. The power supply circuit includes a resistor and a relay connected in parallel, and an input of the power supply circuit is used for coupling with a power supply. The load circuit includes a plurality of sub-load circuits coupled to an output of the power supply circuit. The main controller is coupled to the relay, and in a case where the air conditioner outdoor unit is in a standby state, the main controller is configured to control the relay to turn off, to cause current to flow to at least one sub-load circuit of the plurality of sub-load circuits through the resistor to supply power to the load circuit; and in a case where the air conditioner outdoor unit is in a working state, the main controller is configured to control the relay to turn on, to cause current to flow to the at least one sub-load circuit of the plurality of sub-load circuits through the relay to supply power to the load circuit.

In another aspect, an air conditioner is provided. The air conditioner includes an air conditioner outdoor unit and an air conditioner indoor unit coupled to the air conditioner outdoor unit. The air conditioner outdoor unit includes a power supply circuit, a load circuit and a main controller. The power supply circuit includes a resistor and a relay connected in parallel, and an input of the power supply circuit is used for coupling with a power supply. The load circuit includes a plurality of sub-load circuits coupled to an output of the power supply circuit. The main controller is coupled to the relay, and in a case where the air conditioner outdoor unit is in a standby state, the main controller is configured to control the relay to turn off to cause current to flow to at least one sub-load circuit of the plurality of sub-load circuits through the resistor to supply power to the load circuit; and in a case where the air conditioner outdoor unit is in a working state, the main controller is configured to control the relay to turn on to cause current to flow to the at least one sub-load circuit of the plurality of sub-load circuits through the relay to supply power to the load circuit.

In yet another aspect, a control method of an air conditioner is provided. The air conditioner includes an air conditioner outdoor unit and an air conditioner indoor unit coupled to the air conditioner outdoor unit. The air conditioner outdoor unit includes a power supply circuit, a load circuit and a main controller. The power supply circuit includes a resistor and a relay connected in parallel. The load circuit includes a plurality of sub-load circuits coupled to an output of the power supply circuit. The method includes that in a case where the air conditioner outdoor unit is in a standby state, the main controller controls the relay to turn off to cause current to flow to at least one sub-load circuit of the plurality of sub-load circuits through the resistor to supply power to the load circuit; and, in a case where the air conditioner outdoor unit is in a working state, the main controller controls the relay to turn on to cause current to flow to the at least one sub-load circuit of the plurality of sub-load circuits through the relay to supply power to the load circuit.

In yet another aspect, a computer program product is provided. The computer program product includes computer program instructions stored on a non-transitory computer-readable storage medium. The computer program instructions are used to cause the computer to implement one or more functions of the control method of the air conditioner.

In yet another aspect, a computer-readable storage medium is provided. The computer-readable storage medium stores a program for controlling the air conditioner which, when executed by a computer, causes the computer to perform the control method of the air conditioner.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on an actual size of a product, an actual process of a method and an actual timing of a signal to which the embodiments of the present disclosure relate.

DETAILED DESCRIPTION

Figure 1:
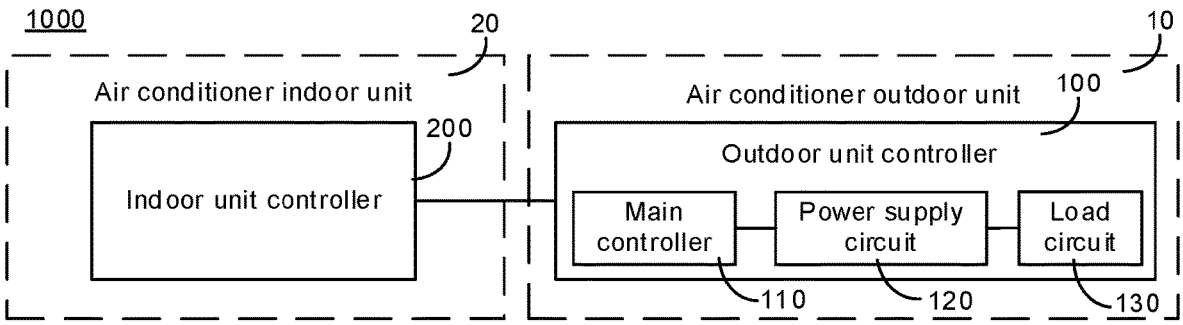
FIG. 1 is a schematic diagram of an air conditioner, in accordance with some embodiments.

Technical solutions in some embodiments of the present disclosure will be described clearly and completely below with reference to the accompanying drawings. However, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the specification and claims, the term "comprise" and other forms thereof such as the third-person singular form "comprises" and the present participle form "comprising" are construed as an open and inclusive meaning, i.e., "including, but not limited to." In the description of the specification, the terms such as "one embodiment", "some embodiments", "exemplary embodiments", "example", "specific example" or "some examples" are intended to indicate that specific features, structures, materials, or characteristics related to the embodiment(s) or example(s) are included in at least one embodiment or example of the present disclosure. The schematic representations of the above terms do not necessarily refer to the same embodiment or example. In addition, the specific features, structures, materials, or characteristics may be included in any one or more embodiments or examples in any suitable manner.

Hereinafter, the terms "first" and "second" are only used for descriptive purposes, and cannot be construed as indicating or implying relative importance or implicitly indicating the number of indicated technical features. Therefore, the features defined with "first" and "second" may explicitly or implicitly include one or more of these features. In the description of the embodiments of the present disclosure, "a/the plurality of" means two or more unless otherwise specified.

In describing some embodiments, the expressions "coupled" and "connected" and their derivatives may be used. For example, the term "connected" may be used when describing some embodiments to indicate that two or more components are in direct physical or electrical contact with each other. For another example, the term "coupled" may be used when describing some embodiments to indicate that two or more components have direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

"At least one of A, B, and C" has the same meaning as "at least one of A, B, or C", and both include the following combinations of A, B, and C: only A, only B, only C, a combination of A and B, a combination of A and C, a combination of B and C, and a combination of A, B and C.

"A and/or B" includes the following three combinations: only A, only B, and a combination of A and B.

As used herein, depending on the context, the term "if" is optionally interpreted to mean "when" or "in a case where" or "in response to determination" or "in response to detection." Similarly, the phrase "if it is determined" or "if [a stated condition or event] is detected", depending on the context, is optionally construed as "in a case where it is determined" or "in response to determining" or "in a case where [the stated condition or event] is detected" or "in response to detecting [the stated condition or event]".

The use of the phrase "applicable to" or "configured to" herein means an open and inclusive language, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values exceeding those stated.

The term "about", "substantially" or "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

The term such as "parallel", "perpendicular" or "equal" as used herein includes a stated condition and a condition similar to the stated condition. A range of the similar condition is within an acceptable range of deviation. The acceptable range of deviation is determined by a person of ordinary skill in the art, considering measurement in question and errors associated with measurement of a particular quantity (i.e., limitations of a measurement system). For example, the term "parallel" includes absolute parallelism and approximate parallelism, and an acceptable range of deviation of the approximate parallelism may be, for example, a deviation within 5°; the term "perpendicular" includes absolute perpendicularity and approximate perpendicularity, and an acceptable range of deviation of the approximate perpendicularity may also be, for example, a deviation within 5°. The term "equal" includes absolute equality and approximate equality, and an acceptable range of deviation of the approximate equality may be, for example, a difference between two equals of less than or equal to 5% of either of the two equals.

Some embodiments of the present disclosure provide an air conditioner. As shown in FIG. 1, the air conditioner 1000 includes an air conditioner outdoor unit 10 and an air conditioner indoor unit 20. The air conditioner outdoor unit 10 includes an outdoor unit controller 100. The air conditioner indoor unit 20 includes an indoor unit controller 200. The outdoor unit controller 100 is coupled to the indoor unit controller 200. A main power supply of the air conditioner 1000 adopts an outdoor power supply mode. That is, a power supply (i.e., a commercial power) is first coupled to the air conditioner outdoor unit 10, and then coupled to the air conditioner indoor unit 20 through the air conditioner outdoor unit 10, so as to supply power to the outdoor unit controller 100 and the indoor unit controller 200.

Figure 2:
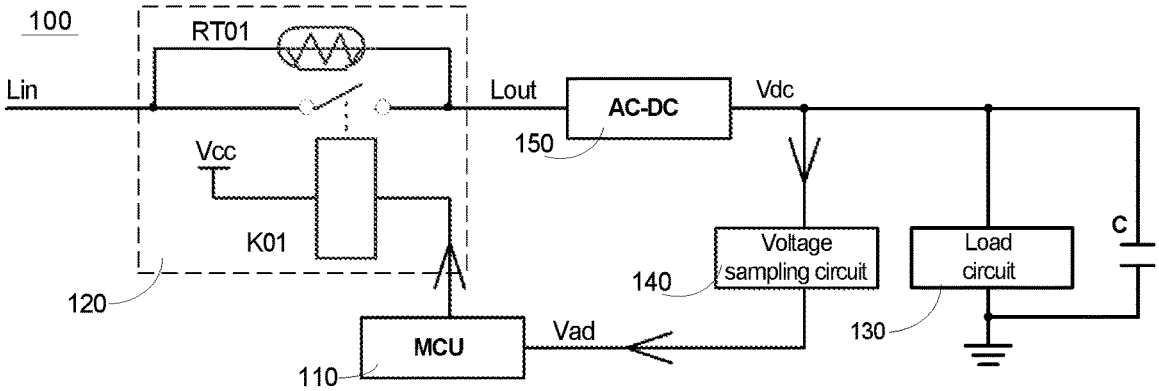
FIG. 2 is a circuit diagram of an outdoor unit controller, in accordance with some embodiments.

In some embodiments, as shown in FIGS. 1 and 2, the outdoor unit controller 100 includes a main controller 110, a power supply circuit 120 and a load circuit 130. The main controller 110 includes, for example, a microcontroller unit (MCU). The load circuit 130 includes a plurality of sub-load circuits.

As shown in FIG. 2, an input Lin of the power supply circuit 120 may be coupled to the indoor unit controller 200, and an output Lout of the power supply circuit 120 may be coupled to the load circuit 130. The input Lin of the power supply circuit 120 is further used for coupling with the power supply. The power supply circuit 120 may include a resistor RT01 and a relay K01 connected in parallel. For example, the resistor RT01 is a positive temperature coefficient (PTC) thermistor or a power resistor. For example, the relay K01 is an electromagnetic relay.

In some embodiments, as shown in FIG. 2, the air conditioner outdoor unit 10 further includes an AC-DC (alternating current-direct current) conversion circuit 150. The AC-DC conversion circuit 150 is coupled between the power supply circuit 120 and the load circuit 130. The AC-DC conversion circuit 150 is configured to convert an AC (alternating current) power output from the output Lout of the power supply circuit 120 into a DC (direct current) power, and supply power to the load circuit 130.

The main controller 110 is configured to determine whether the air conditioner 1000 is in a standby state.

In some examples, the main controller 110 may determine whether the air conditioner 1000 is in the standby state in real time. As shown in FIG. 1, the main controller 110 is coupled to the indoor unit controller 200. If the main controller 110 receives a power-on signal sent by the indoor unit controller 200, it is determined that the air conditioner 1000 is not in the standby state (e.g., the air conditioner 1000 being in a working state). If the main controller 110 receives a power-off signal sent by the indoor unit controller 200, or if the main controller 110 does not receive a power-on signal sent by the indoor unit controller 200 within a preset period of time, it is determined that the air conditioner 1000 is in the standby state.

For example, that the main controller 110 does not receive the power-on signal from the indoor unit controller 200 within the preset period of time is, after the air conditioner 1000 is powered on and before the main controller 110 receives the power-on signal sent by the indoor unit controller 200 for a first time, the main controller 110 determines that the air conditioner 1000 is in the standby state. For another example, after receiving the power-off signal sent by the indoor unit controller 200 and before receiving the power-on signal, the main controller 110 determines that the air conditioner 1000 is in the standby state.

It will be noted that, in a case where the air conditioner 1000 is in the standby state, the air conditioner outdoor unit 10 is also in the standby state. In a case where the air conditioner 1000 is in the working state, the air conditioner outdoor unit 10 is also in the working state. That is, the main controller 110 may be configured to determine whether the air conditioner outdoor unit 10 is in the standby state.

In some examples, users may send a power-on command or a power-off command to the indoor unit controller 200 through, for example, a remote controller or buttons on body of the air conditioner indoor unit 20. The indoor unit controller 200 may send the power-on signal to the main controller 110 after receiving the power-on command, and the indoor unit controller 200 may send the power-off signal to the main controller 110 after receiving the power-off command.

As shown in FIG. 2, the main controller 110 is coupled to the relay K01; if it is determined that the air conditioner 1000 is in the standby state, the main controller 110 is further configured to control the relay K01 to turn off, such that current flows to at least one sub-load circuit of the load circuit 130 through the resistor RT01 to supply power to the load circuit 130; and, if it is determined that the air conditioner 1000 is in the working state, the main controller 110 is further configured to control the relay K01 to turn on, such that current flows to the at least one sub-load circuit of the load circuit 130 through the relay K01 to supply power to the load circuit 130.

In some examples, in a case where the air conditioner 1000 is in the standby state, some of the sub-load circuits do not work (e.g., a detection circuit, a driving circuit and a display circuit may not work), therefore, a power of the load circuit 130 is relatively low (e.g., generally below 1 W). In this case, current flowing through the resistor RT01 is sufficient to enable the at least one sub-load circuit to work normally. In a case where the air conditioner 1000 is in the working state, the main controller 110 is used to drive some components such as an inverter compressor or a fan, therefore, the power of the load circuit 130 is relatively high (e.g., greater than 1 kW). In this case, the relay K01 is controlled to be turned on, since an on-resistance of the relay K01 is almost zero, current flowing through the relay K01 is sufficient to enable the load circuit 130 with a relatively high power to work normally.

In some embodiments of the present disclosure, if the air conditioner 1000 is in the working state, the relay K01 is turned on, and power is supplied to the load circuit 130 through the relay K01. If the air conditioner 1000 is in the standby state, the relay K01 is turned off, such that current flows to the at least one sub-load circuit of the load circuit 130 through the resistor RT01 to supply power to the load circuit 130. In a case where the air conditioner 1000 is in the standby state, the power of the load circuit 130 is small, and current flowing through the resistor RT01 is small. Therefore, a power consumption of the air conditioner 1000 in the standby state may be reduced, and an energy efficiency ratio data of the air conditioner 1000 may be improved, thereby achieving energy saving and consumption reduction. Moreover, since current flowing through the resistor RT01 is small, a temperature of the resistor RT01 will not increase. Therefore, the resistor RT01 will not enter a high-resistance state.

In some embodiments, the outdoor unit controller 100 may further include a capacitor C connected in parallel with the load circuit 130. When the air conditioner 1000 is initially powered on, if the air conditioner 1000 enters the working state immediately, an excessive impulse current may be generated on the capacitor C. In order to avoid this situation, the main controller 110 is configured to determine whether the power-on signal sent by the indoor unit controller 200 is received within a first preset time after the air conditioner 1000 is powered on. If the main controller 110 receives the power-on signal within the first preset time after the air conditioner 1000 is powered on, it is determined that the air conditioner 1000 is in the working state. And when the air conditioner 1000 is powered on for the first preset time, the relay K01 is controlled to be turned on, so as to supply power to the at least one sub-load circuit of the load circuit 130.

In some examples, the first preset time is in a range of 1 s to 60 s inclusive. For example, it may be 1 s, 10 s, 30 s, 45 s, or 60 s.

For example, taking an example in which the first preset time is 30 s, when the air conditioner 1000 is coupled to the power supply, that is, when the main controller 110 receives a voltage signal sent by the power supply, the main controller 110 determines that the air conditioner 1000 is powered on, and further determines whether the air conditioner 1000 receives the power-on signal within 30 s after it is powered on. If the main controller 110 receives the power-on signal within 30 s, the main controller 110 determines that the air conditioner 1000 is in the working state, and controls the relay K01 not to turn on until the air conditioner 1000 is powered on for 30 s. If the main controller 110 receives the power-on signal within 40 s after the air conditioner 1000 is powered on, the main controller 110 determines that the air conditioner 1000 is in the working state, and controls the relay K01 to turn on immediately.

In some examples, the main controller 110 further includes at least one timer. For example, the main controller 110 includes a first timer configured to start timing when the air conditioner 1000 is powered on. In a case where the main controller 110 receives the power-on signal at a timing time of the first timer which is within the first preset time, the main controller will control the relay K01 not to turn on until the timing time of the first timer reaches the first preset time. In a case where the main controller 110 receives the power-on signal at a timing time of the first timer which is greater than or equal to the first preset time, the main controller may control the relay K01 to turn on immediately.

It can be understood that, in some embodiments of the present disclosure, when the air conditioner 1000 is initially powered on, if it is determined that a time when the power-on signal is received is within the first preset time after the air conditioner 1000 is powered on, the relay K01 is controlled to be turned on at or after the first preset time after the air conditioner 1000 is powered on. In this way, the relay K01 may be turned on when a post stage circuit enters a stable working state, so as to avoid that the excessive impulse current may be generated if the relay K01 is turned on immediately at the initial powered on of the air conditioner 1000, which may avoid affecting components in the air conditioner 1000. If a time when the main controller 110 receives the power-on signal is after the first preset time, since the air conditioner 1000 has been in the standby state for a period of time (e.g., greater than the first preset time) when receiving the power-on signal, circuits and components located in the post stage of the power supply circuit 120 have entered the stable working state, and the excessive impulse current will not be generated due to a turning on of the relay K01. Therefore, the main controller 110 may immediately control the turning on of the relay K01 after receiving the power-on signal.

As shown in FIG. 2, in some embodiments, in order to solve a problem that in a case where the air conditioner 1000 is in the standby state, current flowing through the resistor RT01 may be insufficient to supply power to the at least one sub-load circuit of the load circuit 130, the capacitor C is configured to supply power to the at least one sub-load circuit of the load circuit 130 in a case where the air conditioner 1000 is in the standby state.

In some embodiments, the main controller 110 is configured to control the relay K01 to turn on for a third preset time every second preset time in a case where the air conditioner 1000 is in the standby state, so as to charge the capacitor C. In this case, the main controller is further configured to control the relay K01 to turn on when a preset signal is received.

In some examples, the second preset time may be set as any value in a range of 1 min to 60 min inclusive. For example, the second preset time may be set as 5 min, 10 min, 30 min, 45 min or 60 min. In some examples, the third preset time may be set as any value in a range of 1 s to 60 s inclusive. For example, the third preset time may be set as 3 s, 10 s, 25 s, 40 s or 60 s. The preset signal is, for example, the power-on signal sent by the indoor unit controller 200.

For example, in a case where the air conditioner 1000 is in the standby state, the main controller 110 controls the relay K01 to turn off for 10 min, turn on for 3 s, turn off for another 10 min, and turn on for another 3 s until the main controller 110 receives the power-on signal to control the relay K01 to be turned on. When the relay K01 is turned on, the power supply may charge the capacitor C through the relay K01.

In some embodiments, the main controller 110 further includes a second timer configured to start timing in a case where the air conditioner 1000 enters the standby state. In a case where the air conditioner 1000 enters the working state, the second timer stops timing.

For example, in a case where the air conditioner 1000 enters the standby state, the second timer starts timing. When the timing time of the second timer reaches 10 min, the main controller 110 controls the relay K01 to turn on for 3 s and then turn off (i.e., the timing time of the second timer being 603 s when the relay K01 is turned off). When the timing time of the second timer reaches 1203 s, the main controller 110 controls the relay K01 to turn on for 3 s and then turn off. By analogy, the main controller 110 periodically controls the relay K01 to turn on and turn off.

In some embodiments, the relay K01 may be always in a turn-off state within the second preset time. Alternatively, the relay K01 may be in the turn-off state for some time, and in the turn-off state for some time within the second preset time.

It can be understood that, in a case where the air conditioner 1000 is in the standby state and current flowing through the resistor RT01 is insufficient to satisfy a power consumption demand of the load circuit 130, electric energy stored in the capacitor C is consumed, resulting in a drop in the DC voltage across the capacitor C. The capacitor C may be charged by the main controller 110 periodically controlling the relay K01 to turn on, so that the DC voltage across the capacitor C is restored to a normal value. In this way, when current flowing through the resistor RT01 is insufficient to supply power to the at least one sub-load circuit of the load circuit 130, the capacitor C may supply power to the at least one sub-load circuit.

In some embodiments, as shown in FIG. 2, the outdoor unit controller 100 further includes a voltage sampling circuit 140. The voltage sampling circuit 140 is, for example, a resistor voltage divider sampling circuit, which is coupled to the main controller 110 and is connected in parallel with the load circuit 130. The voltage sampling circuit 140 is configured to detect a DC voltage across the load circuit 130, divide the DC voltage, and send a voltage dividing signal Vad to the main controller 110. The main controller 110 is configured to calculate the DC voltage across the load circuit 130 according to a voltage value of the voltage dividing signal Vad. The above-mentioned "divide the DC voltage" means dividing a DC voltage with a large voltage value into a DC voltage with a small voltage value according to a certain ratio. For example, the voltage sampling circuit 140 includes at least two resistors to implement the above-mentioned "divide the DC voltage".

For example, the voltage sampling circuit 140 divides the DC voltage by 1/n of its original voltage to form the voltage dividing signal Vad, and transmits the voltage dividing signal Vad to a Vad terminal of the main controller 110. The main controller 110 multiplies a voltage division value of the voltage dividing signal Vad by n to obtain a value of the DC voltage across the load circuit 130.

In some embodiments, in order to prevent the resistor RT01 from overheating and entering the high-resistance state due to a frequent on or off of the relay K01, and thus unable to supply power to the load circuit 130 normally, the air conditioner outdoor unit 10 further includes the voltage sampling circuit 140 coupled to the main controller 110. In a case where the air conditioner 1000 is in the standby state and the relay K01 is in the turn-off state, when a voltage change rate of the DC voltage across the load circuit 130 collected by the voltage sampling circuit 140 is continuously greater than or equal to a preset change rate for a fourth preset time, the main controller 110 is further configured to control the relay K01 to turn off after turning on for a fifth preset time.

In some embodiments, the main controller 110 further includes a third timer. The third timer is configured to start timing when the relay K01 is in the turn-off state and the voltage change rate across the load circuit 130 is greater than or equal to the preset change rate. If the voltage change rate across the load circuit 130 is continuously greater than or equal to the preset change rate for the fourth preset time, when a timing time of the third timer reaches the fourth preset time, the main controller 110 controls the relay K01 to turn on for the fifth preset time and then turn off. In the above-mentioned timing process, if the voltage change rate across the load circuit 130 is less than the preset change rate at a certain moment, or the relay K01 is turn on, the third timer stops timing and returns to zero. The third timer may further be configured to count the fifth preset time.

In some examples, the fourth preset time may be set as any value in a range of 1 min to 45 min inclusive. For example, the fourth preset time may be set as 3 min, 5 min, 10 min, 30 min or 45 min. The fourth preset time is less than the second preset time. The fifth preset time may be set as any value in a range of 1 s to 60 s inclusive. For example, the fifth preset time may be set as 3 s, 5 s, 10 s, 30 s, 45 s, or 60 s.

For example, as shown in FIG. 2, the voltage sampling circuit 140 detects the DC voltage across the load circuit 130, which is at the post stage of the power supply circuit 120, once per second. In a case where the voltage change rate of the DC voltage is greater than or equal to 0.1 V/s within 3 min (i.e., within 3 min, a difference between a voltage value of the DC voltage at a current second and a voltage value of the DC voltage at a previous second being greater than ±0.1 V), the main controller 110 controls the relay K01 to turn on for 3 s. Since after the relay K01 is turned on, current does not passes through the resistor RT01, but passes through the relay K01 to supply power to the post stage. Therefore, when the relay K01 is turned on, there is no current flowing through the resistor RT01 and the power consumption is zero, and a temperature of the resistor RT01 decreases, so that the load circuit 130 may be normally supplied with power.

In some embodiments, when the air conditioner 1000 is powered on, the second timer starts timing, and the voltage sampling circuit 140 starts to detect the DC voltage across the load circuit 130, which is at the post stage of the power supply circuit 120, once per second. When a difference between a voltage value of the DC voltage at a certain moment (the moment being before an end of the second timer counting the second preset time) and a voltage value of a previous second is greater than ±0.1 V, the third timer starts counting. During a timing process of the third timer, if the difference between the voltage value of the DC voltage and the voltage value of the previous second is continuously greater than ±0.1 V for the fourth preset time, when the timing time of the third timer reaches the fourth preset time, the main controller 110 controls the relay K01 to turn on for the fifth preset time and then to turn off.

During the timing process of the third timer, if the change rate of the DC voltage is less than the preset change rate at a certain moment, or the relay K01 turns on, the third timer stops timing and returns to zero.

In the above-mentioned example, the fourth preset time and the fifth preset time may be timed by a same timer. Alternatively, the fourth preset time and the fifth preset time may be timed by different timers. A number and function of the timer are not limited in the present disclosure, and it is within the scope of the present disclosure as long as an effect of accurately timing the above-mentioned preset time may be achieved.

In some embodiments, in a case where the air conditioner 1000 is in the standby state and the voltage sampling circuit 140 detects that the DC voltage across the load circuit 130 is less than a first preset voltage, the main controller 110 is further configured to control the relay K01 to turn on; and in a case where the voltage sampling circuit 140 detects that the DC voltage across the load circuit 130 is greater than or equal to a second preset voltage, the main controller 110 is further configured to control the relay K01 to turn off. The first preset voltage is less than or equal to the second preset voltage. The first preset voltage is, for example, 170 V, and the second preset voltage is, for example, 250 V.

For example, when the DC voltage across the load circuit 130 is less than the first preset voltage, and the main controller 110 controls the relay K01 to turn on, since the on-resistance of the relay K01 is almost zero and there is no voltage drop, current may flow to the load circuit 130 at the post stage through the relay K01, so as to supply power to the load circuit 130 and increase the DC voltage across the load circuit 130. When the DC voltage across the load circuit 130 is greater than or equal to the second preset voltage, the main controller 110 controls the relay K01 to turn off. When the relay K01 is turned off, current flows to the at least one sub-load circuit of the load circuit 130 through the resistor RT01 to supply power to the load circuit 130. Since the resistor RT01 has the voltage drop, the DC voltage across the load circuit 130 will decrease. When the DC voltage across the load circuit 130 is less than the first preset voltage again, the main controller 110 controls the relay K01 to turn on again, and so on. In this way, it may be avoided that the DC voltage across the load circuit 130 is excessively low in a case where the air conditioner 1000 is in the standby state, thereby preventing an entire electronic control system of the air conditioner 1000 from running out of control.

In some embodiments, in a case where the air conditioner 1000 is in the standby state, the main controller 110 is further configured to control the voltage sampling circuit 140 to detect the DC voltage across the load circuit 130; in a case where the change rate of the DC voltage across the load circuit 130 within the fourth preset time is continuously greater than or equal to the preset change rate, the main controller 110 is further configured to control the relay K01 to turn on for the fifth preset time and then turn off. During the fourth preset time, when a detected DC voltage across the load circuit 130 is less than the first preset voltage, the main controller 110 controls the relay K01 to turn on until the DC voltage is greater than or equal to the second preset voltage, then the main controller 110 controls the relay K01 to turn off, and the voltage sampling circuit 140 re-detects the change rate of the DC voltage across the load circuit 130.

Figure 3:
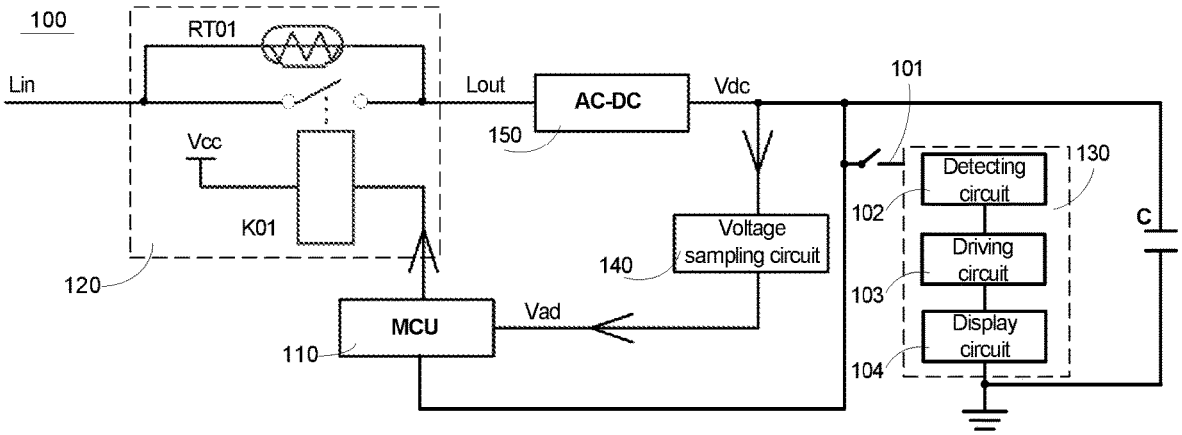
FIG. 3 is a circuit diagram of another outdoor unit controller, in accordance with some embodiments.

In some embodiments, as shown in FIG. 3, the air conditioner outdoor unit 10 further includes a switch 101. The switch 101 couples the output Lout of the power supply circuit 120 to the at least one sub-load circuit, and the switch 101 is coupled to the main controller 110. The main controller 110 may further be configured to control on or off of the switch 101. For example, in a case where the air conditioner 1000 is in the standby state, the main controller 110 is further configured to control the switch 101 to turn off, so as to stop supplying power to the at least one sub-load circuit; and, in a case where the air conditioner 1000 is in the working state, the main controller 110 is further configured to control the switch 101 to turn on, so as to supply power to the at least one sub-load circuit. For example, power is supplied to all sub-load circuits.

Figure 4:
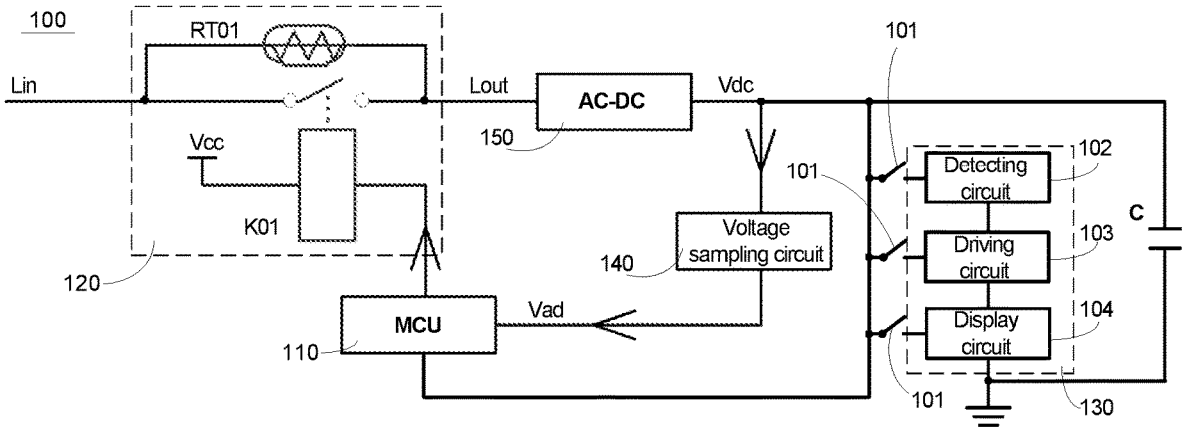
FIG. 4 is a circuit diagram of yet another outdoor unit controller, in accordance with some embodiments.

In some examples, as shown in FIG. 3, the load circuit 130 includes a plurality of sub-load circuits such as a detecting circuit 102, a driving circuit 103, and a display circuit 104. In this case, as shown in FIG. 4, the air conditioner outdoor unit 10 may include a plurality of switches 101 coupled to the plurality of sub-load circuits respectively. Alternatively, the air conditioner outdoor unit 10 may include one switch 101 coupled to the plurality of sub-load circuits. Of course, a coupling relationship between the switch 101 and the sub-load circuits is not limited thereto. The air conditioner outdoor unit 10 may include two switches 101, one switch 101 is coupled to two or more sub-load circuits, and another switch 101 is coupled to one sub-load circuit. In a case where the air conditioner 1000 is in the standby state, power supply circuit interfaces of the plurality of sub-load circuits are provided at a post terminal of the plurality of switches 101, and the main controller 110 flexibly controls the on or off of the plurality of switches 101. In this way, the sub-load circuits at the working state may be flexibly powered, and thus the standby power consumption of the air conditioner 1000 may be reduced.

For example, in a case where the air conditioner 1000 is in the standby state, the detecting circuit 102, the driving circuit 103 and the display circuit 104 may not work. In a case where the air conditioner 1000 is in the standby state, the main controller 110 controls the switch 101 coupled to the detecting circuit 102, the driving circuit 103 and the display circuit 104 to turn off, which may further reduce the standby power consumption of the air conditioner 1000.

In some examples, the detecting circuit 102, for example, may be a temperature detecting circuit configured to detect a working ambient temperature of the air conditioner outdoor unit 10. The driving circuit 103, for example, may be a signal driving circuit configured to amplify a functional signal output by the outdoor unit controller 100. The display circuit 104, for example, may be a display circuit of an indicator light, or a display circuit of a display screen. The display circuit 104 is configured to transmit operation information of the air conditioner 1000 to the display device, and the operation information is displayed by the display device. The operation information may include, for example, the operation state of the air conditioner outdoor unit 10.

In the air conditioner 1000 according to the embodiments of the present disclosure, it is possible to control the on or off of the relay K01 in the power supply circuit 120 according to the working state of the air conditioner 1000 and the DC voltage across the load circuit 130 after the air conditioner 1000 is powered on without changing a circuit structure. In this way, not only the standby power consumption of the air conditioner 1000 may be reduced, but also an energy efficiency ratio data of the air conditioner 1000 may be improved, so as to achieve energy saving and consumption reduction.

Figure 5:
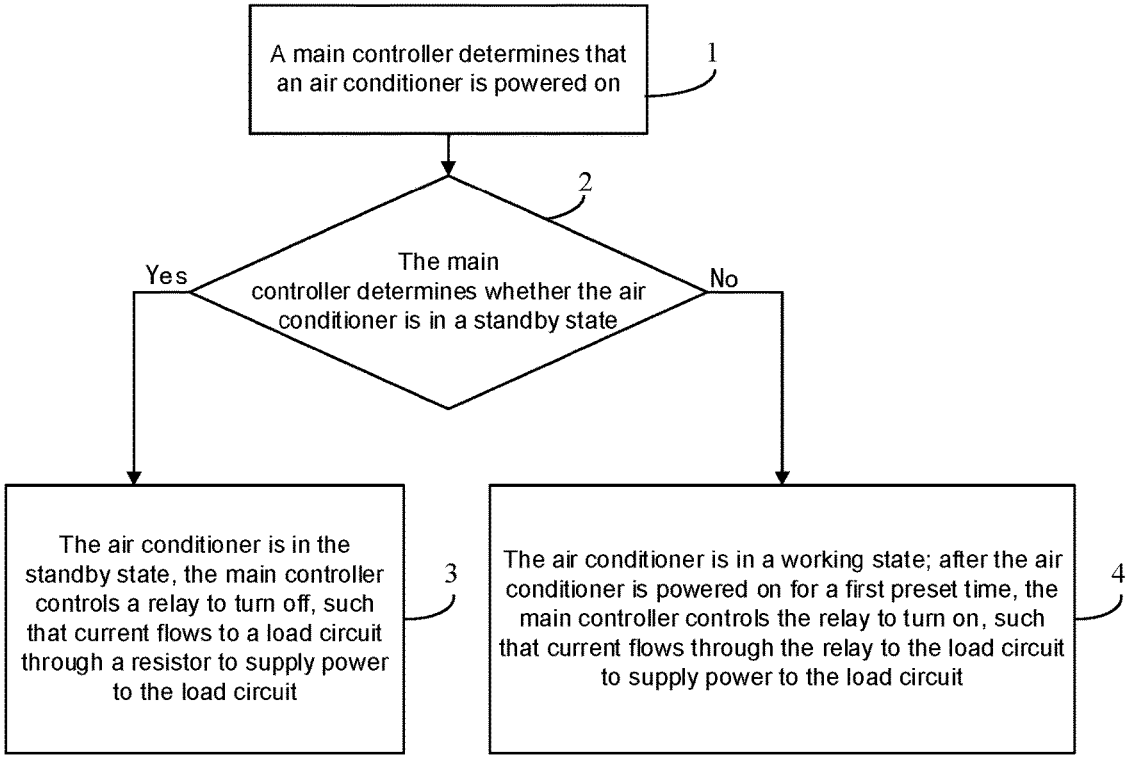
FIG. 5 is a flow diagram of a control method of an air conditioner, in accordance with some embodiments.

Some embodiments of the present disclosure provide a control method of the air conditioner. The method is executed by, for example, a main controller 110, and the main controller 110 may be the main controller 110 described in any of the above embodiments. As shown in FIG. 5, the method includes steps 1 to 4.

In step 1, the main controller 110 determines that the air conditioner 1000 is powered on.

For example, when the air conditioner 1000 is coupled to the power supply, that is, when the main controller 110 receives the voltage signal (e.g., the voltage signal from the power supply), it is determined that the air conditioner 1000 is powered on, and then step 2 is executed.

In step 2, the main controller 110 determines whether the air conditioner 1000 is in the standby state.

For example, if the main controller 110 does not receive the power-on signal sent by the indoor unit controller 200, or if the main controller 110 receives the power-off signal sent by the indoor unit controller 200, it is determined that the air conditioner 1000 is in the standby state, and the main controller 110 controls the air conditioner 1000 to execute step 3. If the main controller 110 receives the power-on signal sent by the indoor unit controller 200, it is determined that the air conditioner 1000 is not in the standby state (e.g., the air conditioner 1000 being in the working state), and the main controller 110 controls the air conditioner 1000 to execute step 4.

In step 3, if the air conditioner 1000 is in the standby state, the main controller 110 controls the relay K01 to turn off, such that current flows to at least one sub-load circuit of the load circuit 130 through the resistor RT01 to supply power to the load circuit 130.

If the air conditioner 1000 is powered on and in the standby state, the relay K01 is controlled to be turned off, and current flows to at least one sub-load circuit of the load circuit 130 through the resistor RT01 to supply power to the load circuit 130. In this case, the resistor RT01 does not enter the high-resistance state, so that the power consumption of the air conditioner 1000 in the standby state is reduced, and the energy efficiency ratio data of the air conditioner may be improved, so as to achieve energy saving and consumption reduction.

In step 4, if the air conditioner 1000 is in the working state, the main controller 110 controls the relay K01 to turn on, such that current flows to the at least one sub-load circuit of the load circuit 130 through the relay K01 to supply power to the load circuit 130.

In some embodiments, step 4 may include that the main controller 110 controlling the relay K01 to turn on in a case where the air conditioner 1000 is in the working state and the air conditioner 1000 is powered on for the first preset time, such that current flows to the at least one sub-load circuit of the load circuit 130 through the relay K01 to supply power to the load circuit 130. In this way, the relay K01 may be turned on when a post stage circuit enters the stable working state, so as to avoid that the excessive impulse current may be generated if the relay K01 is turned on immediately at the initial powered on of the air conditioner 1000, which may affect the components in the air conditioner 1000.

It will be noted that, the main controller 110 further includes a timer configured to count each preset time in the air conditioner 1000, such as a first preset time, a second preset time, a third preset time, a fourth preset time, and a fifth preset time.

Figure 6:
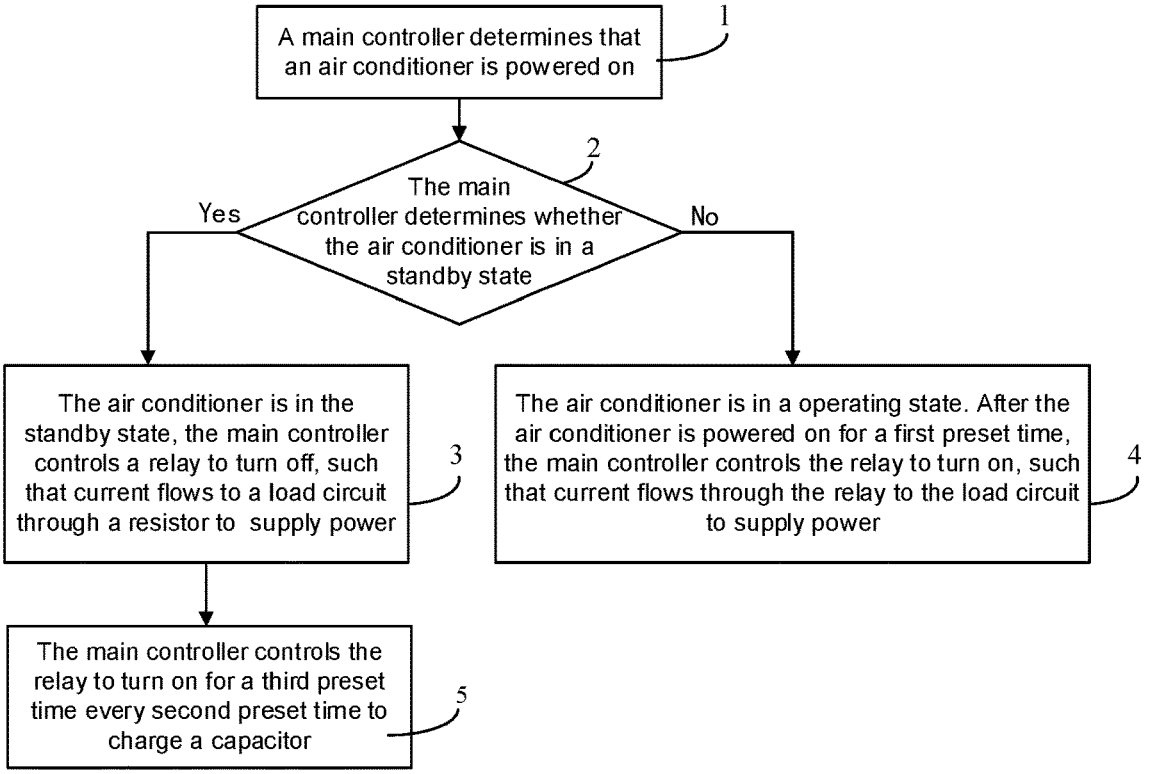
FIG. 6 is a flow diagram of another control method of an air conditioner, in accordance with some embodiments.

In some embodiments, the air conditioner outdoor unit 10 of the air conditioner 1000 further includes a capacitor C connected in parallel with the plurality of sub-load circuits. As shown in FIG. 6, the method may further include step 5 other than the above-mentioned steps 1 to 4. Step 5 may be executed after step 3.

In step 5, the main controller 110 controls the relay K01 to turn on for a third preset time every second preset time, so as to charge the capacitor C.

In a case where the air conditioner 1000 is in the standby state, in order to prevent the current flowing through the resistor RT01 from being insufficient to satisfy the power consumption requirement of the load circuit 130, the main controller 110 may control the relay K01 to turn on for the third preset time every second preset time. When the relay K01 is turned on, the capacitor C may be charged through the relay K01. In this way, when current flowing through the resistor RT01 is insufficient to supply power to the at least one sub-load circuit of the load circuit 130, the capacitor C may supply power to the at least one sub-load circuit.

Figure 7:
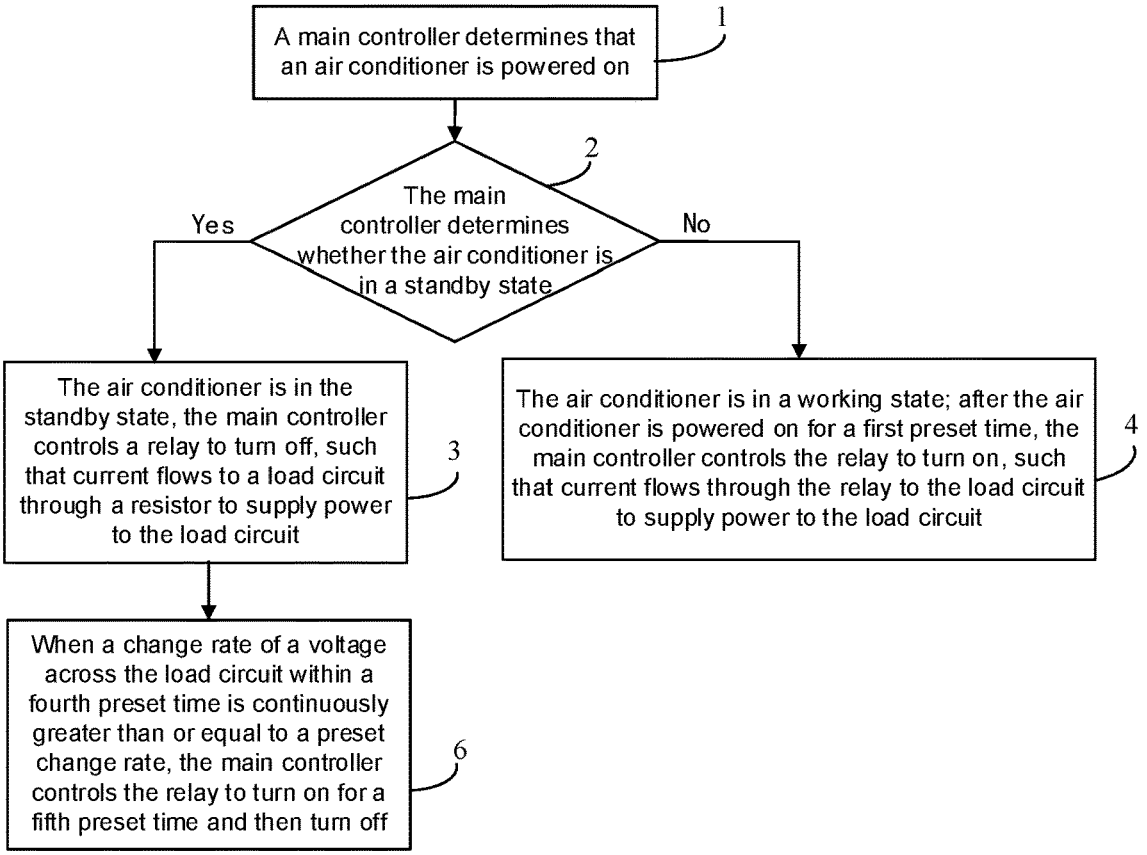
FIG. 7 is a flow diagram of yet another control method of an air conditioner, in accordance with some embodiments.

In some embodiments, the air conditioner outdoor unit 10 further includes a voltage sampling circuit 140, and the output of the power supply circuit 120 is coupled to the main controller 110 through the voltage sampling circuit 140. The voltage sampling circuit 140 is configured to detect the DC voltage across the load circuit 130. As shown in FIG. 7, the method may further include step 6 other than the above-mentioned steps 1 to 4. Step 6 may be executed after step 3.

In step 6, when the change rate of the DC voltage across the load circuit 130 within the fourth preset time is continuously greater than or equal to the preset change rate, the main controller 110 controls the relay K01 to turn on for the fifth preset time and then turn off.

In a case where the air conditioner 1000 is in the standby state, the frequent on or off of the relay K01 may cause the resistor RT01 to overheat and enter the high-resistance state, and in order to avoid this situation, a DC voltage (e.g., Vdc) across the load circuit 130, which is at the post stage of the power supply circuit 120, may be detected by the voltage sampling circuit 140; and, when the change rate of the DC voltage is continuously greater than or equal to a preset change rate (e.g., 0.1 V/s) for the fourth preset time, the relay K01 is controlled to be turned on by the main controller 110 for the fifth preset time (e.g., 1 s to 60 s). In this way, after the relay K01 is turned on, current does not pass through the resistor RT01; instead, power is supplied to the post stage through the relay K01. Therefore, when the relay K01 is turned on, there is no current flowing through the resistor RT01, and the power consumption of the resistor RT01 is zero, so that the temperature of the resistor RT01 may be reduced and the resistor RT01 may work properly.

Figure 8:
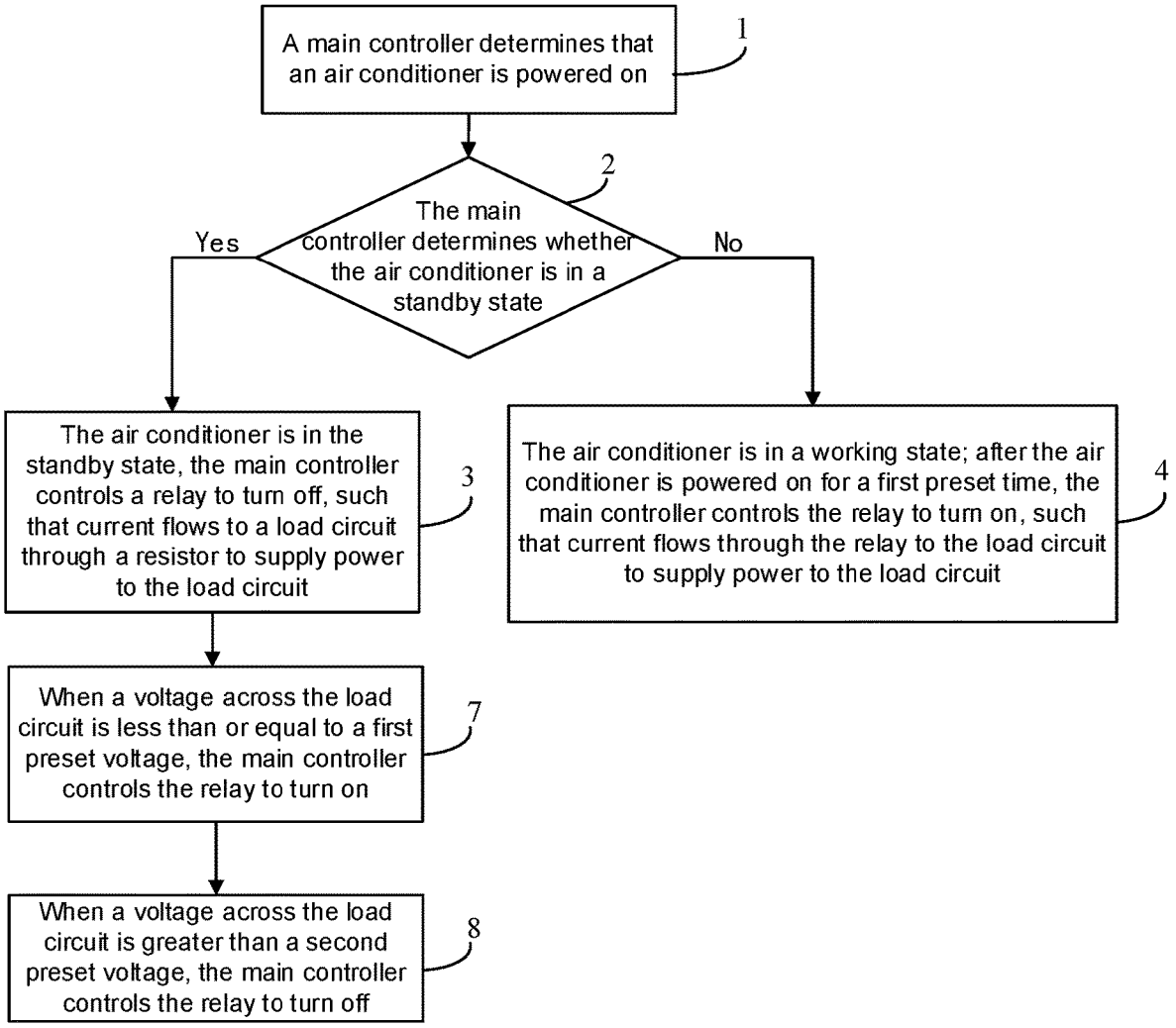
FIG. 8 is a flow diagram of yet another control method of an air conditioner, in accordance with some embodiments.

In some embodiments, as shown in FIG. 8, the method may further include step 7 and step 8 other than the above-mentioned steps 1 to 4. Step 7 and step 8 may be executed after step 3.

In step 7, when the voltage sampling circuit 140 detects that the voltage across the load circuit 130 is less than or equal to the first preset voltage, the main controller 110 controls the relay K01 to turn on, and executes step 8.

In step 8, when the voltage sampling circuit 140 detects that the voltage across the load circuit 130 is greater than the second preset voltage, the main controller 110 controls the relay K01 to turn off. The first preset voltage is less than or equal to the second preset voltage.

In a case where the air conditioner 1000 is in the standby state and the relay K01 is in the turn-off state, current flows to the at least one sub-load circuit of the load circuit 130 through the resistor RT01 to supply power to the load circuit 130. Since the resistor RT01 has the voltage drop, and the DC voltage across the load circuit 130 continues to decrease. Therefore, when the DC voltage across the load circuit 130 is less than the first preset voltage, the main controller 110 may control the relay K01 to turn on and increase the DC voltage across the load circuit 130. When the DC voltage across the load circuit 130 is greater than or equal to the second preset voltage, the main controller 110 controls the relay K01 to turn off. In this way, the DC voltage across the load circuit 130 may be prevented from being excessively low when the air conditioner 1000 is in the standby state, thereby preventing an entire electronic control system of the air conditioner 1000 from running out of control.

In the control method of the air conditioner according to the embodiments of the present disclosure, it is possible to control the on or off of the relay K01 in the power supply circuit 120 according to the working state of the air conditioner 1000 and the DC voltage across the load circuit 130 after the air conditioner 1000 is powered on without changing the circuit structure. In this way, not only the standby power consumption of the air conditioner 100 may be reduced, but also the energy efficiency ratio data of the air conditioner 1000 may be improved, so as to achieve energy saving and consumption reduction.

Figure 9:
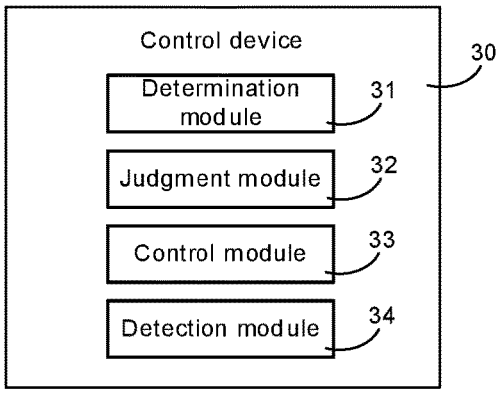
FIG. 9 is a block diagram of a control device of an air conditioner, in accordance with some embodiments.

Some embodiments of the present disclosure provide a control device of the air conditioner. FIG. 9 is a block diagram of the control device of the air conditioner, in accordance with some embodiments. As shown in FIG. 9, the control device 30 of the air conditioner includes a determination module 31, a judgment module 32 and a control module 33.

In some embodiments, the determination module 31 is configured to determine that the air conditioner is powered on. The judgment module 32 is configured to judge whether the air conditioner 1000 is in the standby state. The control module 33 is configured to control the on or off of the relay K01.

For example, in a case where the air conditioner 1000 is in the standby state, the control module 33 controls the relay K01 to turn off, such that current flows to the at least one sub-load circuit of the load circuit 130 through the resistor RT01 to supply power to the load circuit 130. In a case where the air conditioner 1000 is in the working state, the control module 33 controls the relay K01 to turn on, such that current flows to at least one sub-load circuit of the load circuit 130 through the relay K01 to supply power to the load circuit 130.

In some embodiments, when the air conditioner 1000 is powered on for the first preset time, the control module 33 is configured to control the relay K01 to turn on, such that current flows to the at least one sub-load circuit of the load circuit 130 through the relay K01 to supply power to the load circuit 130. In this way, the relay K01 may be turned on when the post stage circuits enter the stable working state, and it may be avoided that the excessive impulse current may be generated if the relay K01 is turned on immediately at the time when the air conditioner 1000 is initially powered on. The excessive impulse current may affect the components in the air conditioner 1000.

As shown in FIG. 2, in some embodiments, in order to solve a problem that in a case where the air conditioner 1000 is in the standby state, current flowing through the resistor RT01 may be insufficient to supply power to the at least one sub-load circuit of the load circuit 130, the outdoor unit controller 100 may further include a capacitor C connected in parallel with the load circuit 130. The capacitor C is configured to supply power to the at least one sub-load circuit of the load circuit 130 in a case where the air conditioner 1000 is in the standby state.

In some embodiments, the control module 33 is configured to control the relay K01 to turn on for the third preset time every second preset time, so as to charge the capacitor C in a case where the air conditioner 1000 is in the standby state. In this case, the control module 33 is further configured to control the relay K01 to turn on when the control module 33 receives the power-on signal sent by the indoor unit controller 200.

In some embodiments, as shown in FIG. 9, in order to prevent the resistor RT01 from overheating and entering the high-resistance state due to the frequent on or off of the relay K01, the air conditioner outdoor unit 10 further includes a detection module 34. In a case where the air conditioner 1000 is in the standby state and the relay K01 is in the turn-off state, when the change rate of the DC voltage across the load circuit 130 collected by the voltage sampling circuit 140 is continuously greater than or equal to the preset change rate for the fourth preset time, the control module 33 is further configured to control the relay K01 to turn off after turning on for the fifth preset time.

In some embodiments, in order to prevent the DC voltage across the load circuit 130 from being excessively low in the standby state, causing the entire electronic control system of the air conditioner 1000 to run out of control, in a case where the air conditioner 1000 is in the standby state, the control module 33 is further configured to controls the relay K01 to turn on if the detection module 34 detects that the DC voltage across the load circuit 130 is less than the first preset voltage; and, the control module 33 is further configured to control the relay K01 to turn off if the detection module 34 detects that the DC voltage across the load circuit 130 is greater than or equal to the second preset voltage. The first preset voltage is less than or equal to the second preset voltage. The first preset voltage is, for example, 170 V, and the second preset voltage is, for example, 250 V.

It can be understood that, in order to implement the above-mentioned functions, the air conditioner 1000 may include corresponding hardware structures and/or software modules for executing each function. The modules and steps of each example described in conjunction with the above-described embodiments of the present disclosure may be implemented in a form of a combination of hardware (e.g., circuits) and computer software. For example, functions of the determination module 31, the judgment module 32, the control module 33 and the detection module 34 may be implemented by circuits and/or software.

It will be noted that, when the control device 30 of the air conditioner in some embodiments of the present disclosure controls the air conditioner, its implementation manner is similar to that of the air conditioner in some embodiments of the present disclosure, and will not be repeated herein.

Some embodiments of the present disclosure further provide a computer program product. The computer program product includes computer program instructions, the computer program instructions enable a computer to implement one or more functions of the control method of the air conditioner according to any of the above embodiments.

Some embodiments of the present disclosure further provide a non-transitory computer-readable storage medium. A control program of the air conditioner is stored on the computer-readable storage medium. The computer is made to execute one or more steps of the control method of the air conditioner according to any one of the above embodiments when the control program of the air conditioner is executed by the computer.

For example, the computer-readable storage medium may include, but is not limited to: a magnetic storage device (e.g., a hard disk, a floppy disk, or a magnetic tape), an optical disk (e.g., a compact disk (CD)), a digital versatile disk (DVD), a smart card and a flash memory device (e.g., an erasable programmable read-only memory (EPROM), a card, a stick or a key drive). The various computer-readable storage media described in the present disclosure may represent one or more devices and/or other machine-readable storage media for storing information. The term "machine-readable storage media" may include, but are not limited to, wireless channels and various other media capable of storing, containing, and/or carrying instruction(s) and/or data.

Figure 10:
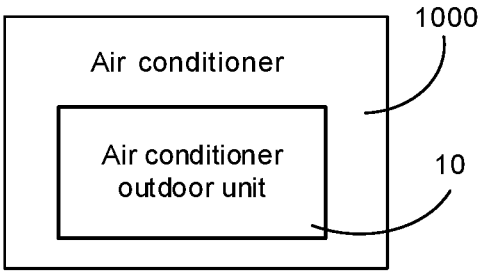
FIG. 10 is a block diagram of an air conditioner, in accordance with some embodiments.

Some embodiments of the present disclosure further provide an air conditioner outdoor unit 10. As shown in FIG. 10, the air conditioner outdoor unit 10 is same as the air conditioner outdoor unit 10 included in the air conditioner 1000 in any of the above embodiments, and has beneficial effects of the air conditioner 1000 in any of the above embodiments, which will not be repeated herein.

Figure 11:
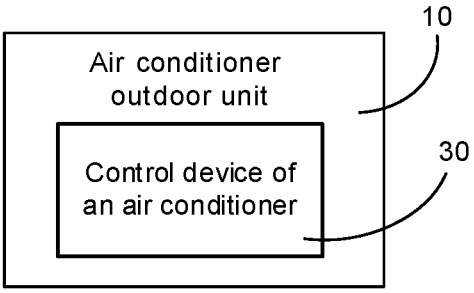
FIG. 11 is a block diagram of an air conditioner outdoor unit, in accordance with some embodiments.

Some embodiments of the present disclosure further provide an air conditioner outdoor unit 10. As shown in FIG. 11, the air conditioner outdoor unit 10 includes the control device 30 of the air conditioner described in any of the above embodiments, and has beneficial effects of the control device 30 of the air conditioner described in any of the above embodiments, which will not be repeated herein.

Figure 12:
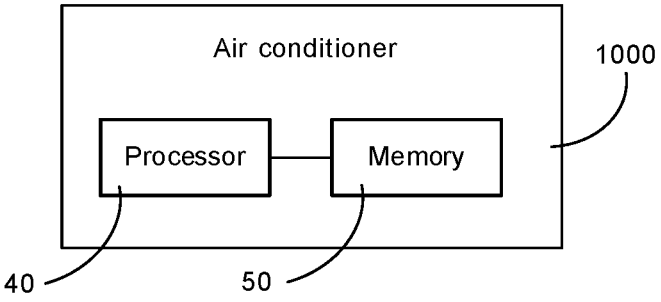
FIG. 12 is a block diagram of another air conditioner, in accordance with some embodiments.

Some embodiments of the present disclosure further provide an air conditioner 1000. As shown in FIG. 12, the air conditioner 1000 includes a processor 40, a memory 50, and a control program of the air conditioner stored on the memory 50 and executable on the processor 40. For example, the processor 40 may be a central processing unit (CPU). The memory 50 may be a random access memory (RAM) or a read-only memory (ROM). The control program of the air conditioner implements the control method of the air conditioner as described above when the control program of the air conditioner is executed by the processor 40.

Beneficial effects of the control device 30, the computer-readable storage medium, the air conditioner outdoor unit 10, and the air conditioner 1000 are similar to that of the control method of the air conditioner described above, and will not be repeated herein.

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

A person skilled in the art will understand that, the scope of disclosure involved in the present disclosure is not limited to technical solutions formed by specific combinations of the above technical features, and shall cover other technical solutions formed by any combination of the above technical features or their equivalent features without departing from the concept of disclosure. For example, technical solutions formed by replacing the above features with technical features with similar functions disclosed in some embodiments (but not limited thereto).

What is claimed is:

1. An air conditioner outdoor unit, comprising:

a power supply circuit including a resistor and a relay connected in parallel, an input of the power supply circuit for coupling with a power supply;

a load circuit including a plurality of sub-load circuits coupled to an output of the power supply circuit;

a main controller coupled to the relay and configured to:

control the relay to turn off in a case where the air conditioner outdoor unit is in a standby state, to cause current to flow to at least one sub-load circuit of the plurality of sub-load circuits through the resistor to supply power to the load circuit; and control the relay to turn on in a case where the air conditioner outdoor unit is in a working state, to cause current to flow to the at least one sub-load circuit of the plurality of sub-load circuits through the relay to supply power to the load circuit;

wherein, the main controller is configured to control the relay to turn on in a case where the air conditioner outdoor unit is in the working state and the air conditioner outdoor unit is powered on for a first preset time, to cause the current to flow to the at least one sub-load circuit of the plurality of sub-load circuits through the relay to supply power to the load circuit.

2. The air conditioner outdoor unit according to claim 1, further comprising a capacitor connected in parallel with the plurality of sub-load circuits; wherein, the capacitor is configured to supply power to the at least one sub-load circuit of the plurality of sub-load circuits in a case where the air conditioner outdoor unit is in the standby state.

3. The air conditioner outdoor unit according to claim 2, wherein, the main controller is configured to control the relay to turn on for a third preset time every second preset time in a case where the air conditioner outdoor unit is in the standby state, so as to charge the capacitor.

4. The air conditioner outdoor unit according to claim 1, further comprising a voltage sampling circuit, the output of the power supply circuit being coupled to the main controller through the voltage sampling circuit;

the voltage sampling circuit being configured to detect a voltage across the load circuit.

5. The air conditioner outdoor unit according to claim 4, wherein, the main controller is further configured to control the relay to turn on for a fifth preset time and then turn off, in a case where the air conditioner outdoor unit is in the standby state and a change rate of the voltage across the load circuit is greater than or equal to a preset change rate for a fourth preset time.

6. The air conditioner outdoor unit according to claim 4, wherein, in a case where the air conditioner outdoor unit is in the standby state, the main controller is further configured to:

control the relay to turn on when the voltage across the load circuit is less than or equal to a first preset voltage; and control the relay to turn off when the voltage across the load circuit is greater than the second preset voltage.

7. The air conditioner outdoor unit according to claim 1, further comprising at least one switch, the output of the power supply circuit being coupled to the plurality of sub-load circuits through the at least one switch, wherein, the main controller is further configured to:

control one or more switches of the at least one switch to turn off and stop supplying power to the at least one sub-load circuit of the plurality of sub-load circuits in a case where the air conditioner outdoor unit is in the standby state; and control one or more switches of the at least one switch to turn on and supply power to the at least one sub-load circuit of the plurality of sub-load circuits in a case where the air conditioner outdoor unit is in the working state.

8. An air conditioner, comprising:

the air conditioner outdoor unit according to claim 1, and an air conditioner indoor unit coupled to the air conditioner outdoor unit.

9. The air conditioner according to claim 8, wherein, the air conditioner indoor unit includes an indoor unit controller coupled to the main controller, and the main controller is configured to:

determine that the air conditioner is in the standby state when the main controller does not receive a power-on signal sent by the indoor unit controller within a preset period of time, or receives a power-off signal sent by the indoor unit controller; and determine that the air conditioner is in the working state when the main controller receives the power-on signal sent by the indoor unit controller.

10. A control method of an air conditioner, the air conditioner including an air conditioner outdoor unit, and an air conditioner indoor unit coupled to the air conditioner outdoor unit; the air conditioner outdoor unit including a power supply circuit, a load circuit and a main controller; the power supply circuit including a resistor and a relay connected in parallel; the load circuit including a plurality of sub-load circuits, the plurality of sub-load circuits being coupled to an output of the power supply circuit; the method comprising:

controlling, by the main controller, the relay to turn off in a case where the air conditioner outdoor unit is in a standby state, to cause current to flow to at least one sub-load circuit of the plurality of sub-load circuits through the resistor to supply power to the load circuit; and controlling, by the main controller, the relay to turn on in a case where the air conditioner outdoor unit is in a working state, to cause current to flow to the at least one sub-load circuit of the plurality of sub-load circuits through the relay to supply power to the load circuit;

wherein controlling the relay to turn on in a case where the air conditioner outdoor unit is in the working state, to cause current to flow to the at least one sub-load circuit of the plurality of sub-load circuits through the relay to supply power to the load circuit, includes:

controlling, by the main controller, the relay to turn on in a case where the air conditioner outdoor unit is in the working state and the air conditioner outdoor unit is powered on for a first preset time, to cause current to flow to the at least one sub-load circuit of the plurality of sub-load circuits through the relay to supply power to the load circuit.

11. The method according to claim 10, wherein, the air conditioner outdoor unit further includes a capacitor connected in parallel with the plurality of sub-load circuits.

12. The method according to claim 11, further comprising:

controlling, by the main controller, the relay to turn on for a third preset time every second preset time in a case where the air conditioner outdoor unit is in the standby state, so as to charge the capacitor.

13. The method according to claim 10, wherein, the air conditioner outdoor unit further includes a voltage sampling circuit; the output of the power supply circuit is coupled to the main controller through the voltage sampling circuit.

14. The method according to claim 13, further comprising:

controlling, by the main controller, the relay to turn on for a fifth preset time and then turn off, in a case where the air conditioner outdoor unit is in the standby state and a change rate of a voltage across the load circuit is greater than or equal to a preset change rate for a fourth preset time.

15. The method according to claim 13, wherein, in a case where the air conditioner outdoor unit is in the standby state, the method further comprising:

controlling, by the main controller, the relay to turn on when the voltage sampling circuit detects that the voltage across the load circuit is less than or equal to a first preset voltage, and controlling, by the main controller, the relay to turn off when the voltage sampling circuit detects that the voltage across the load circuit is greater than a second preset voltage.

16. The method according to claim 10, wherein, the air conditioner outdoor unit further includes at least one switch; the output of the power supply circuit is coupled to the plurality of sub-load circuits through the at least one switch, and the method further comprising:

controlling, by the main controller, one or more switches of the at least one switch to turn off and stopping supplying power to the at least one sub-load circuit of the plurality of sub-load circuits in a case where the air conditioner outdoor unit is in the standby state; and controlling, by the main controller, one or more switches of the at least one switch to turn on and supplying power to the at least one sub-load circuit of the plurality of sub-load circuits in a case where the air conditioner outdoor unit is in the working state.

17. A non-transitory computer-readable storage medium storing a control program of an air conditioner which, when executed by a computer, causes the computer to perform the method of the air conditioner according to claim 10.

18. An air conditioner, comprising an air conditioner outdoor unit, and an air conditioner indoor unit coupled to the air conditioner outdoor unit, wherein, the air conditioner outdoor unit includes:

a power supply circuit including a resistor and a relay connected in parallel;

an input of the power supply circuit for coupling with a power supply;

a load circuit including a plurality of sub-load circuits coupled to an output of the power supply circuit;

a main controller coupled to the relay and being configured to:

control the relay to turn off in a case where the air conditioner outdoor unit is in a standby state, to cause current to flow to at least one sub-load circuit of the plurality of sub-load circuits through the resistor to supply power to the load circuit; and control the relay to turn on in a case where the air conditioner outdoor unit is in a working state, to cause current to flow to the at least one sub-load circuit of the plurality of sub-load circuits through the relay to supply power to the load circuit;

wherein, the air conditioner indoor unit includes an indoor unit controller coupled to the main controller, and the main controller is configured to:

determine that the air conditioner is in the standby state when the main controller does not receive a power-on signal sent by the indoor unit controller within a preset period of time, or receives a power-off signal sent by the indoor unit controller; and determine that the air conditioner is in the working state when the main controller receives the power-on signal sent by the indoor unit controller.

* * * * *